US008099954B2

(12) United States Patent
Hoshi

(10) Patent No.: US 8,099,954 B2
(45) Date of Patent: Jan. 24, 2012

(54) EXHAUST MANIFOLD

(75) Inventor: Koichi Hoshi, Susono (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 265 days.

(21) Appl. No.: 12/497,161

(22) Filed: Jul. 2, 2009

(65) Prior Publication Data

US 2010/0000201 A1 Jan. 7, 2010

(30) Foreign Application Priority Data

Jul. 3, 2008 (JP) ..... 2008-174981

(51) Int. Cl.
*F01N 1/00* (2006.01)
*F01N 3/00* (2006.01)
*F01N 3/10* (2006.01)

(52) U.S. Cl. ..... 60/323; 60/324; 60/276; 60/285; 60/305

(58) Field of Classification Search ..... 60/276, 60/285, 305, 324, 323
See application file for complete search history.

(56) References Cited

U.S. PATENT DOCUMENTS 7,454,901 B2 * 11/2008 Kato et al. ..... 60/324
2009/0126355 A1 5/2009 Uchida

FOREIGN PATENT DOCUMENTS

CN 201062535 Y 5/2008
JP 2003083061 3/2003
JP 2005256785 9/2005
WO WO 2007086277 A1 * 8/2007
WO WO-2007086277 A1 8/2007

* cited by examiner

*Primary Examiner* — Thomas Denion
*Assistant Examiner* — Michael Carton
(74) *Attorney, Agent, or Firm* — Gifford, Krass, Sprinkle, Anderson & Citkowski, P.C.

(57) ABSTRACT

An exhaust manifold includes a plurality of branch pipes that guide exhaust gas discharged from cylinders, and a junction pipe that converges downstream-side end portions of the plurality of branch pipes in a flow direction of exhaust gas, and that has a drawn portion that is formed by drawing so as to be constricted in a radial direction of the drawn portion. The junction pipe is provided with a sensor that detects the oxygen concentration in exhaust gas. The sensor is provided at a downstream side of a deepest draw inside diameter in the flow direction of exhaust gas. The deepest draw inside diameter is the smallest inside diameter of the drawn portion.

11 Claims, 5 Drawing Sheets

EXHAUST MANIFOLD

INCORPORATION BY REFERENCE

The disclosure of Japanese Patent Application No. 2008-174981 filed on Jul. 3, 2008 including the specification, drawings and abstract is incorporated herein by reference in its entirety.

BACKGROUND OF THE INVENTION

1. Field of the Invention

The invention relates to an exhaust manifold that guides exhaust gas that is discharged from cylinders.

2. Description of the Related Art

As an exhaust manifold of this type, there is known an assembly structure of an exhaust manifold which includes a plurality of branch pipes, and a junction portion in which downstream-side end portions of the branch pipes are converged and housed (e.g., see Japanese Patent Application Publication No. 2005-256785 (JP-A-2005-256785)). In the structure of this junction portion of the exhaust manifold, a reduced-diameter portion that has a reduced diameter is formed in the junction portion, and an oxygen sensor is disposed in the smallest inside diameter portion in the reduced-diameter portion. Therefore, the exhaust gas that flows from all the branch pipes into the junction portion can be gathered in the reduced-diameter portion so as to hit the oxygen sensor. Hence, the oxygen concentration can be highly accurately measured.

In the foregoing structure of the junction portion of the exhaust manifold, the exhaust gas discharged from the branch pipes is guided along wall surfaces of the junction portion so as to flow into the reduced-diameter portion. Therefore, while the exhaust gas that flows into the reduced-diameter portion can be gathered in the reduced-diameter portion and can be caused to hit the oxygen sensor, the exhaust gas passes through the reduced-diameter portion without being sufficiently diffused. Therefore, the oxygen sensor may receive a relatively large amount of exhaust gas discharged from a nearby branch pipe, in a unit time.

SUMMARY OF THE INVENTION

The invention provides an exhaust manifold capable of improving the detection accuracy of a sensor that detects the oxygen concentration.

An aspect of the invention relates to an exhaust manifold. The exhaust manifold includes: a plurality of branch pipes that guide exhaust gas discharged from cylinders; and a junction pipe that converges downstream-side end portions of the plurality of branch pipes in a flow direction of exhaust gas, and that has a drawn portion that is formed by drawing so as to be constricted in a radial direction of the drawn portion. In this exhaust manifold, the junction pipe is provided with a sensor that detects oxygen concentration in exhaust gas, and the sensor is provided at a downstream side of a deepest draw inside diameter in the flow direction of exhaust gas, and the deepest draw inside diameter is the smallest inside diameter of the drawn portion.

In the exhaust manifold of this aspect, the drawn portion is formed in the junction pipe that is connected to the downstream-side ends of the branch pipes in a flow direction of exhaust gas, and the sensor is disposed at the downstream side of the deepest draw inside diameter of the drawn portion. Due to this construction, the exhaust gas discharged from each of the branch pipes are guided along an inner wall surface of the junction pipe, and passes through the portion of the junction pipe which has the deepest draw inside diameter, and flows to the downstream side of the deepest draw inside diameter. At this time, as exhaust gas passes through the portion having the deepest draw inside diameter, the exhaust gas changes its flow direction. Specifically, the exhaust gas discharged from a branch pipe that is remote from the sensor comes to flow toward the sensor. Because of this, the exhaust manifold of the invention is able to improve the detection accuracy of the sensor.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

An exhaust manifold in accordance with an embodiment of the invention will be described hereinafter with reference to the accompanying drawings. Incidentally, the following embodiment does not limit the invention. For example, the component elements of the following embodiment include elements that can be replaced by those skilled in the art, or elements that are substantially the same as component elements.

Figure 1:
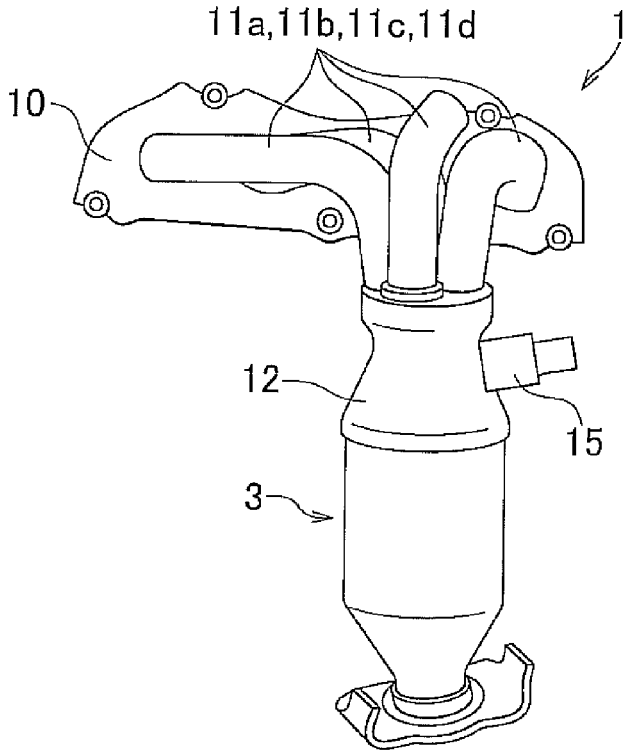
FIG. 1 is an exterior perspective view of an exhaust manifold in accordance with an embodiment of the invention.

A exhaust manifold 1 will be described with reference to FIG. 1 to FIG. 3. The exhaust manifold 1 guides the exhaust gas discharged from the cylinders of an engine (not shown), to the purification catalyst device 3 that purifies exhaust gas. The engine is constituted by, for example, an in-line four-cylinder engine, and discharges the exhaust gas produced in each cylinder through an exhaust port thereof. The purification catalyst device 3 contains therein a three-way catalyst 4.

The exhaust manifold 1 includes a head flange 10 connected to the engine, a plurality of branch pipes 11*a*, 11*b*, 11*c*, 11*d* connected to the head flange 10, and a junction pipe 12 connected to the branch pipes 11*a*, 11*b*, 11*c*, 11*d*. In this embodiment, the number of the branch pipes provided is four. Besides, in the junction pipe 12, an air-fuel ratio sensor 15 is provided as a sensor that detects the oxygen concentration in exhaust gas. Although the embodiment employs the air-fuel ratio sensor 15, an oxygen sensor may instead be employed.

Each of the four branch pipes 11*a*, 11*b*, 11*c*, 11*d* is connected, at an upstream-side end portion thereof that is located upstream in terms of the flow direction of exhaust gas, to an exhaust port of one of the cylinders of the engine, via the head flange 10. Besides, the four branch pipes 11*a*, 11*b*, 11*c*, 11*d* are converged together at their downstream-side end portions that are located downstream in terms of the exhaust gas flow direction. Concretely, in a view of the downstream-side end portions of the branch pipes 11*a*, 11*b*, 11*c*, 11*d* in the axial direction thereof, the downstream-side end portion of each branch pipe has a generally fan shape as shown in FIG. 2, and L shaped portions of the fan-shaped portions are adjacent to each other so that the downstream-side end portions of the plurality of branch pipes 11*a*, 11*b*, 11*c*, 11*d* are circular in cross-section. In addition, a partition wall 20 is provided between the branch pipes 11*a*, 11*b*, 11*c*, 11*d*, and the air-fuel ratio sensor 15 is disposed directly under the partition wall 20.

An upstream-side end portion of the junction pipe 12 is connected to the downstream-side end portions of the branch pipes 11*a*, 11*b*, 11*c*, 11*d*, and a downstream-side end portion of the junction pipe 12 is connected to an upstream-side end portion of the purification catalyst device 3. The junction pipe 12 is formed so as to have a cylindrical shape, and is integrally formed by a drawn portion 25 which is formed at a center in the axial direction by drawing, an exhaust gas lead-in portion 26 formed on the upstream side of the drawn portion 25, and an exhaust gas lead-out portion 27 formed on the downstream side of the drawn portion 25.

The drawn portion 25 is formed by drawing so as to be constricted in radial directions all around the circumference of the junction pipe 12. Besides, as shown in FIG. 3, the drawn portion 25 is formed so that an inner peripheral surface of the drawn portion is protruded radially inwards, in a section of the drawn portion taken along an axial direction of the junction pipe, and the drawn portion 25 is formed by a curved plane that has a summit that gives a deepest draw inside diameter D2 that is the smallest inside diameter of the junction pipe 12. In other words, the drawn portion 25 is formed so that the inside diameter of the junction pipe 12 gradually expands toward the upstream side and the downstream side in the exhaust gas flow direction, from the portion that has the deepest draw inside diameter D2 and that can be regarded as a ridge. Therefore, the exhaust gas converged by the drawn portion 25 is not kept in the converged state, but can be certainly mixed and diffused at the downstream side of the drawn portion 25. That is, the exhaust gas discharged from the junction pipe 12 mixes and diffuses at the downstream side of the deepest draw inside diameter D2, and then flows into the purification catalyst device 3. Therefore, the exhaust manifold 1 can cause the exhaust gas to uniformly hit the three-way catalyst 4, so that a long service life of the purification catalyst device 3 can be realized.

In comparison, if the drawn portion 25 is a straight pipe, the exhaust gas may converge as it passes through the drawn portion 25, and the converged exhaust gas may fail to sufficiently diffuse. In this case, exhaust gas, remaining in the converged state, flows into the three-way catalyst 4 of the purification catalyst device 3 disposed at the downstream side. Therefore, the exhaust gas hits a central portion of the three-way catalyst 4, so that the degradation of a center portion of the three-way catalyst 4 may become faster than the degradation of a peripheral portion, and the three-way catalyst 4 cannot be sufficiently utilized, and therefore the service life of the purification catalyst device 3 may become short.

The upstream-side end portion of the exhaust gas lead-in portion 26 is fitted to the outside of the downstream-side end portions of the assembled branch pipes 11*a*, 11*b*, 11*c*, 11*d*, and the downstream-side end portion of the exhaust gas lead-in portion 26 is continuous to the upstream-side end portion of the drawn portion 25. That is, the inside diameter of the exhaust gas lead-in portion 26 becomes gradually smaller from the upstream-side end portion toward the downstream-side end portion. Therefore, the exhaust gas lead-in portion 26 is formed by a curved plane that is convex radially outwards. Concretely, the exhaust gas lead-in portion 26 has a lead-in straight portion 30 that is formed to a predetermined length from the upstream side end, a lead-in curve portion 31 that gradually reduces in diameter continuously from the lead-in straight portion 30, and a lead-in funnel portion 32 that is formed to a predetermined length continuously from the lead-in curve portion 31. Because of this, the exhaust gas lead-in portion 26 is able to appropriately guide the exhaust gas discharged from the branch pipes 11*a*, 11*b*, 11*c*, 11*d*, toward the drawn portion 25, without causing the exhaust gas to dwell. Due to this, the influence of the pressure loss on the cylinders can be lessened.

The upstream-side end portion of the exhaust gas lead-out portion 27 is continuous to the downstream-side end portion of the drawn portion 25, and the downstream-side end portion of the exhaust gas lead-out portion 27 is fitted to the outside of the upstream-side end portion of the purification catalyst device 3. That is, the inside diameter of the exhaust gas lead-out portion 27 gradually becomes larger from the upstream-side end portion toward the downstream-side end portion. Therefore, the exhaust gas lead-out portion 27 is formed by a curved plane that is convex radially outwards. Concretely, the exhaust gas lead-out portion 27 has a lead-out funnel portion 35 that is formed to a predetermined length from the upstream side end of the exhaust gas lead-out portion 27, a lead-out curve portion 36 that gently expands in diameter continuously from the lead-out funnel portion 35, and a lead-out straight portion 37 that is formed to a predetermined length continuously from the lead-out curve portion 36. Therefore, similarly to the exhaust gas lead-in portion 26, the exhaust gas lead-out portion 27 is able to appropriately guide the exhaust gas discharged from the drawn portion 25, toward the three-way catalyst of the purification catalyst device 3, without causing the exhaust gas to dwell, so that the influence of pressure loss on each cylinder can be lessened.

The foregoing drawing formation is carried out so that the ratio K between the inside diameter D1 of the upstream-side end portion of the junction pipe 12 and the deepest draw inside diameter D2 of the junction pipe 12 ($K=D2/D1$) is $0.7<K<1$. Therefore, in the drawn portion 25, exhaust gas is guided to the exhaust gas lead-out portion 27 without being caused to dwell, so that the influence of the pressure loss on the cylinders can be lessened.

As described above, the junction pipe 12 is provided with the air-fuel ratio sensor 15, and the air-fuel ratio sensor 15 is disposed so as to be positioned at the downstream side of a portion of the junction pipe 12 that has the deepest draw inside diameter D2. The air-fuel ratio sensor 15 is disposed in the vicinity of the portion that has the deepest draw inside diameter D2. Concretely, in the axis direction of the junction pipe 12, the distance between the air-fuel ratio sensor 15 and the portion that has the deepest draw inside diameter D2 is shorter than the distance between the air-fuel ratio sensor 15 and the downstream-side end of the junction pipe 12. Besides, the air-fuel ratio sensor 15 is positioned directly under the partition wall 20 that is provided between the branch pipe 11*b* and the branch pipe 11*d*, and is disposed parallel to the partition wall 20. Therefore, the air-fuel ratio sensor 15 is disposed at a position that is near the branch pipes 11*b*, 11*d* and that is remote from the branch pipes 11*a*, 11*c*. In this embodiment, the air-fuel ratio sensor 15 is disposed to extend in parallel with the partition wall 20.

Therefore, exhaust gas, after being discharged from the cylinders of the engine, flows into the branch pipes 11*a*, 11*b*, 11*c*, 11*d* via the head flange 10. After flowing into the branch pipes 11*a*, 11*b*, 11*c*, 11*d*, the exhaust gas passes through the branch pipes 11*a*, 11*b*, 11*c*, 11*d*, and then flows into the junction pipe 12.

The exhaust gas from the cylinders, having flown into the junction pipe 12, passes through the exhaust gas lead-in portion 26 of the junction pipe 12, and then flows into the drawn portion 25 of the junction pipe 12. At this time, a portion of the exhaust gas hits the inner peripheral surface of the drawn portion 25, and changes its flow direction. Specifically, as the exhaust gas discharged from the branch pipes 11*a*, 11*c* that are remote from the air-fuel ratio sensor 15 passes through the drawn portion 25, a portion of the exhaust gas forms a flow that moves radially inwards, and another portion thereof forms a flow that moves downward in the axis direction. At this time, the exhaust gas moving radially inwards hits the air-fuel ratio sensor 15.

On the other hand, as the exhaust gas discharged from the branch pipes 11*b*, 11*d* that are near the air-fuel ratio sensor 15 passes through the drawn portion 25, a portion of the exhaust gas forms a flow that moves radially inwards, and another portion thereof forms a flow that moves downward in the axis direction. At this time, the exhaust gas moving downward in the axis direction hits the air-fuel ratio sensor 15. Thus, since a portion of the exhaust gas from each one of the cylinders passing through the drawn portion 25 hits the air-fuel ratio sensor 15, the air-fuel ratio of each cylinder can be appropriately detected.

As a result, the exhaust gas from each cylinder passing through the drawn portion 25 flows in various directions, so that the exhaust gases from the cylinders are mixed in the exhaust gas lead-out portion 27, and diffuse so as to form a uniform exhaust gas flow at the downstream-side end portion of the exhaust gas lead-out portion 27. Owing to this, the exhaust gas flowing out of the exhaust gas lead-out portion 27 can uniformly hit an upstream-side end surface 4*a* of the three-way catalyst 4. Therefore, the junction pipe 12 does not cause exhaust gas to hit the three-way catalyst 4 one-sidedly or non-uniformly, but is able to cause exhaust gas to uniformly hit the three-way catalyst 4. Hence, it becomes possible to efficiently use the three-way catalyst 4 of the purification catalyst device 3, and therefore the service life of the purification catalyst device 3 can be prolonged.

With reference to FIG. 2, FIG. 4, FIG. 5 and FIG. 6, comparisons will be made between the detection performance of the air-fuel ratio sensor 15 in the case where the air-fuel ratio sensor 15 is disposed so as to be positioned directly under the branch pipe 11*d* in the exhaust manifold 1 and the detection performance of the air-fuel ratio sensor 15 in the embodiment which is disposed so as to be positioned directly under the partition wall 20 formed between the branch pipe 11*b* and the branch pipe 11*d*.

Figure 2:
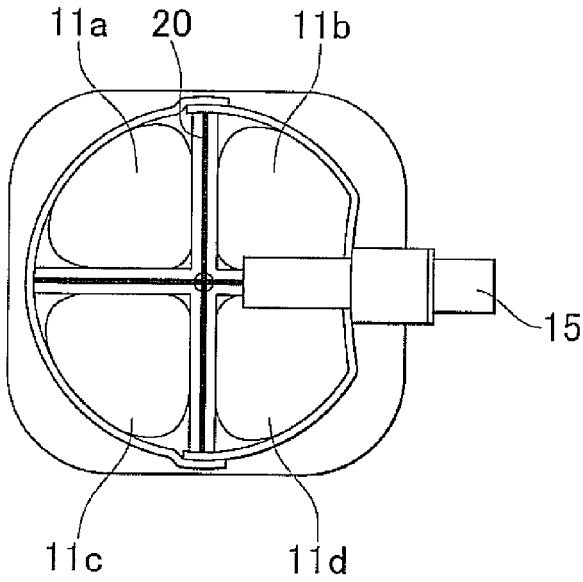
FIG. 2 is a sectional view of the exhaust manifold in accordance with the embodiment of the invention in the axial direction.
Figure 3:
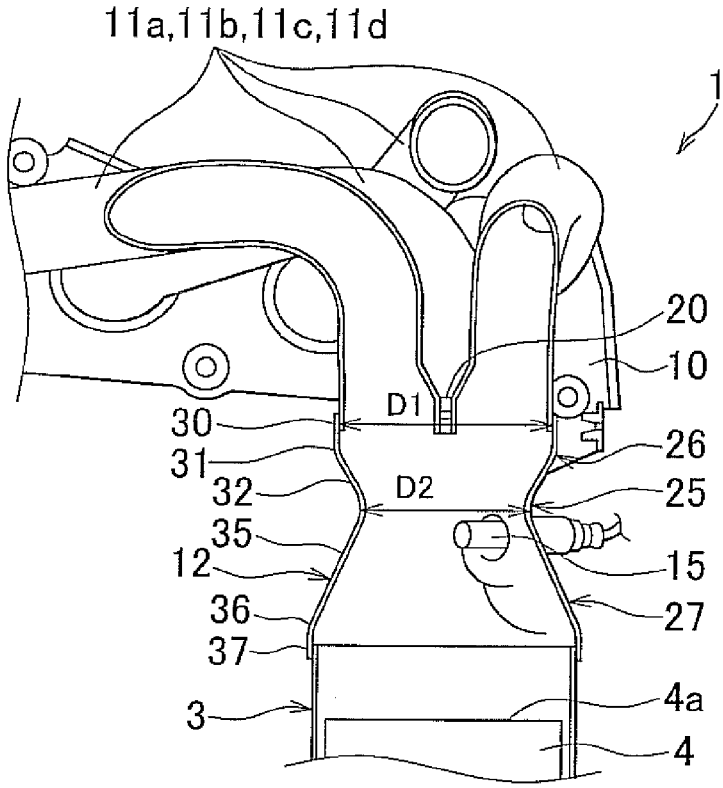
FIG. 3 is a sectional view of the exhaust manifold in accordance with the embodiment of the invention in a radial direction.
Figure 4:
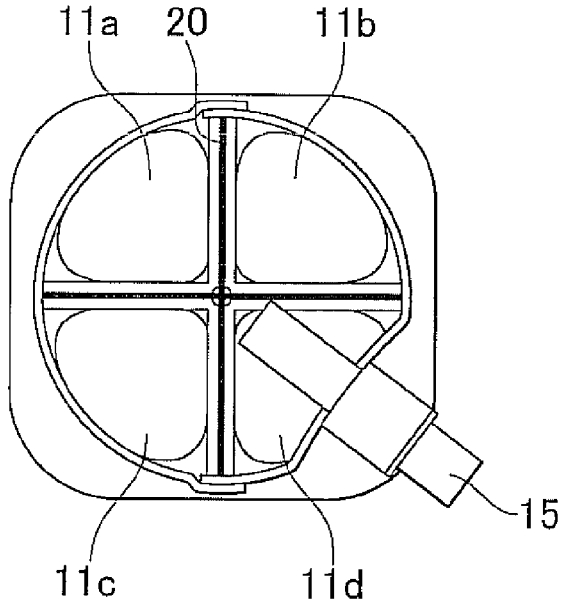
FIG. 4 is a sectional view of the exhaust manifold in the axial direction in the case where an air-fuel ratio sensor is disposed directly under a branch pipe.
Figure 5:
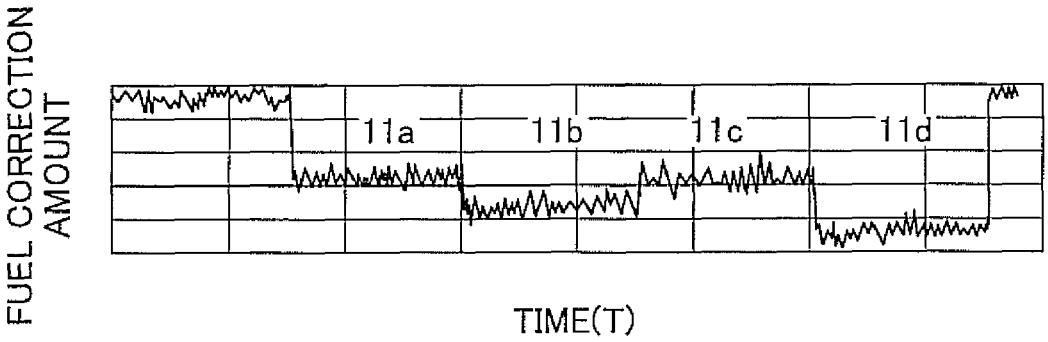
FIG. 5 is a graph representing the detection performance of the air-fuel ratio sensor at the installation position shown in FIG. 4.
Figure 6:
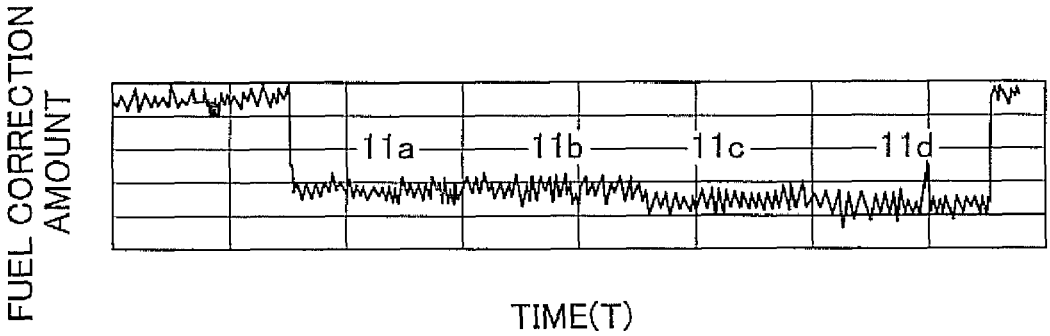
FIG. 6 is a graph representing the detection performance of the air-fuel ratio sensor at the installation position shown in FIG. 2.

The detection performance of the air-fuel ratio sensor 15 positioned as shown in FIG. 4 is represented in the graph shown in FIG. 5, and the detection performance of the air-fuel ratio sensor 15 of this embodiment shown in FIG. 2 is represented in the graph shown in FIG. 6. The graphs shown in FIG. 5 and FIG. 6, the horizontal axis is a time axis, and the vertical axis represents the amount of correction of the amount of fuel injection, that is, represents the fuel correction amount. The graphs of FIG. 5 and FIG. 6 show the fuel correction amount of each cylinder during each period, and in the graphs, a value at a lower position indicates a large fuel correction amount, and a value at an upper position indicates a small fuel correction amount. In a method that measures the detection performance of the air-fuel ratio sensor 15, the amount of fuel injected into each of the four cylinders is increased by 10%. Subsequently, the air-fuel ratio of the exhaust gas discharged through the branch pipes 11*a*, 11*b*, 11*c*, 11*d* from the cylinders following the combustion of the increased amount of fuel is detected by the air-fuel ratio sensor 15. Next, on the basis of results of the detection by the air-fuel ratio sensor 15, an air-fuel ratio feedback control is performed so as to achieve a predetermined air-fuel ratio. At this time, it is detected whether or not a large amount of exhaust gas from each cylinder is caused to hit the air-fuel ratio sensor 15, by determining whether or not the fuel correction amount brought about by the air-fuel ratio feedback control is large. The larger the amount of exhaust gas that hits the air-fuel ratio sensor 15, the larger the fuel correction amount.

From the graph shown in FIG. 5, it can be understood that the fuel correction amount caused by the air-fuel ratio feedback control became largest when the air-fuel ratio sensor 15 detected the air-fuel ratio of the exhaust gas discharged from the branch pipes 11*d* positioned directly above the air-fuel ratio sensor 15. Specifically, the exhaust gas discharged from the branch pipe 11*d*, which is the nearest to the air-fuel ratio sensor 15, hits the air-fuel ratio sensor 15 in the largest amount. Besides, the exhaust gas discharged from the branch pipe 11*b*, which is the second nearest to the air-fuel ratio sensor 15, hits the air-fuel ratio sensor 15 in the second largest amount. Then, the exhaust gas discharged from the branch pipe 11*a* or the branch pipe 11*c*, which is remote from the air-fuel ratio sensor 15, hits the air-fuel ratio sensor 15 in the smallest amount. The amount of the exhaust gas from the branch pipe 11*a* which hits the air-fuel ratio sensor 15 and the amount of the exhaust gas from the branch pipe 11*c* which hits the air-fuel ratio sensor 15 are substantially the same.

From the foregoing description, it can be understood that, in the case where the air-fuel ratio sensor 15 is disposed so as to be positioned directly under the specific one of the branch pipes 11*a*, 11*b*, 11*c*, 11*d*, the exhaust gas discharged from the branch pipe 11*d* that is near the air-fuel ratio sensor 15 hits the air-fuel ratio sensor 15 in a large amount.

From the graph shown in FIG. 6, in the case where the air-fuel ratio of the exhaust gas discharged from the branch pipes 11*a*, 11*b*, 11*c*, 11*d* is detected by the air-fuel ratio sensor 15, the fuel correction amounts caused by the air-fuel ratio feedback control with respect to the individual cylinders are substantially the same. That is, the amounts of the exhaust gases that are discharged from the branch pipes 11*a*, 11*b*, 11*c*, 11*d* and that hit the air-fuel ratio sensor 15 are substantially the same.

From the foregoing description, it can be understood that, in the case where the air-fuel ratio sensor 15 is disposed so as to be positioned directly under the partition wall 20 between the branch pipe 11*b* and the branch pipe 11*d*, the amounts of exhaust gas that are discharged from the branch pipes 11*a*, 11*b*, 11*c*, 11*d* and that hit the air-fuel ratio sensor 15 are substantially equal.

Figure 7:
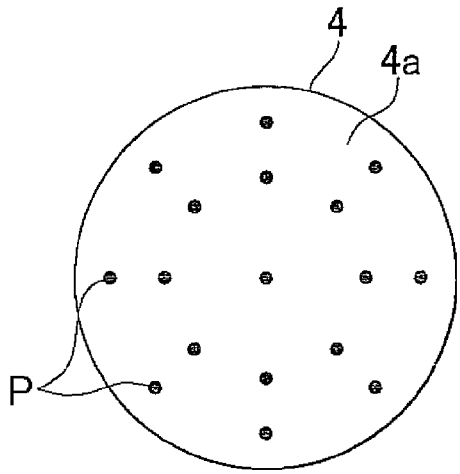
FIG. 7 is an illustrative diagram showing the positions of 17 measurement points on an upstream-side end surface of a three-way catalyst.
Figure 8:
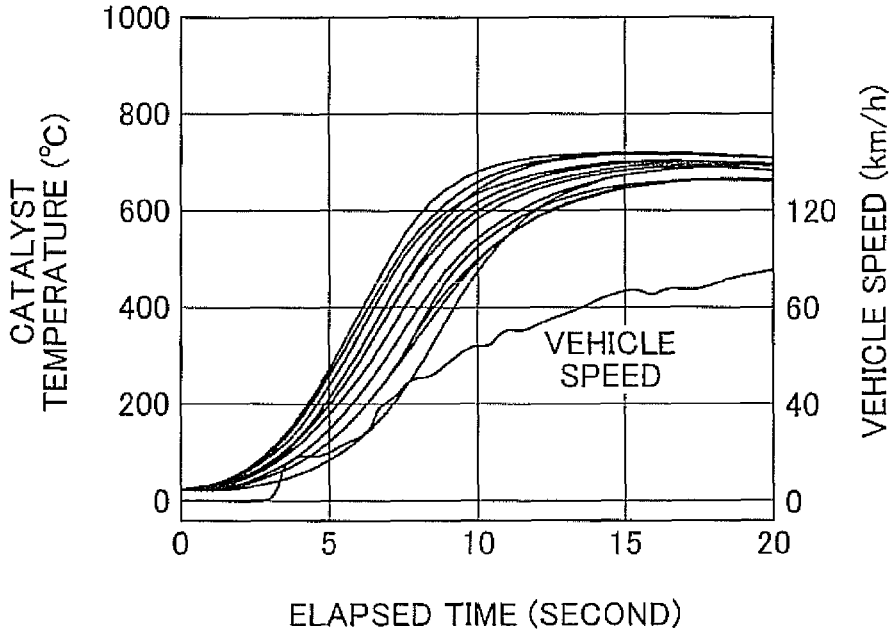
FIG. 8 is a graph representing changes in the temperature of the three-way catalyst at each of the measurement points in the case where the junction pipe is a straight pipe.
Figure 9:
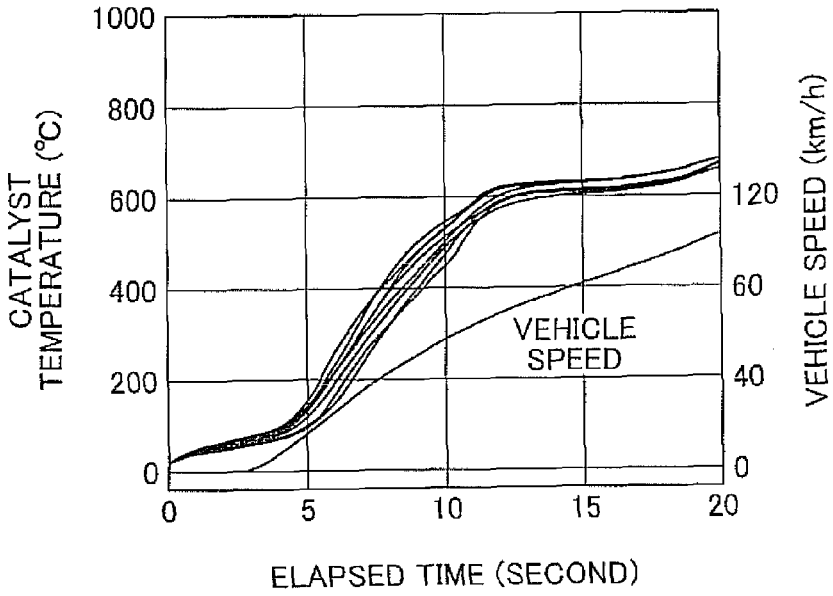
FIG. 9 is a graph representing changes in the temperature of the three-way catalyst at each of the measurement points in the case where the junction pipe in accordance with the embodiment of the invention is employed.

With reference to FIGS. 7 to 9, comparisons will be made between results of the measurement of how exhaust gas hit the three-way catalyst 4 in the case where the junction pipe 12 of the exhaust manifold 1 was not provided with the drawn portion 25 (see FIG. 8), that is, the case where the junction pipe 12 was a straight pipe, and results of the measurement of how exhaust gas hit the three-way catalyst 4 in the case where the junction pipe 12 was provided with the drawn portion 25 as in the embodiment (see FIG. 9). As shown in FIG. 7, temperature was measured at a total of 17 measurement points on the upstream-side end surface 4*a* of the three-way catalyst 4. Incidentally, the 17 measurement points P are disposed radially from the center of the upstream-side end surface 4*a* of the three-way catalyst 4.

In the graph of FIG. 8 showing results of the measurement of the exhaust manifold whose junction pipe is a straight pipe and the graph of FIG. 9 showing results of the measurement of the exhaust manifold 1 of the embodiment, the horizontal axis is a time axis, and the left-side vertical axis represents the catalyst temperature, and the right-side vertical axis represents the vehicle speed. As for the measurement method, the temperature rises of the three-way catalyst 4 is measured when the vehicle was fully accelerated to 100 km/h from a still-standing state after the engine was started from a cold state of the engine.

By comparing the measurement results shown in FIG. 8 and the measurement results of the exhaust manifold of the embodiment shown in FIG. 9, it can be understood that the exhaust manifold 1 of the embodiment has smaller variation in the temperature rise of the three-way catalyst 4 than the exhaust manifold whose measurement results are shown in FIG. 8. Specifically, since the temperature of the upstream-side end surface 4*a* of the three-way catalyst 4 rose uniformly over the entire upstream-side end surface 4*a* of the three-way catalyst 4 of the purification catalyst device 3 to which the exhaust manifold 1 of the embodiment was linked, it can be understood that exhaust gas hit the upstream-side end surface 4*a* of the three-way catalyst 4.

As described above, the accuracy in the detection of the air-fuel ratio by the air-fuel ratio sensor 15 can be improved by forming the drawn portion 25 in the junction pipe 12, and disposing the air-fuel ratio sensor 15 at the downstream side of the deepest draw inside diameter D2 of the drawn portion 25. Besides, the exhaust gas discharged from the junction pipe 12 can be caused to uniformly hit the upstream-side end portion of the three-way catalyst of the purification catalyst device 3. Since the diameter ratio K is $0.7<K<1$, the diameter of the drawn portion 25 is not reduced more than necessary, so that exhaust gas can be appropriately guided to the exhaust gas lead-out portion 27 without causing exhaust gas to dwell in the drawn portion 25.

Besides, since the inner peripheral surface of the drawn portion 25 is a curved plane that is convex radially inwards, the exhaust gas converged in the drawn portion 25 is not kept in the converged state, but can be diffused at the downstream side of the drawn portion 25.

Furthermore, since the inner peripheral surface of the exhaust gas lead-in portion 26 is formed as a curved plane that is convex radially outwards, the exhaust gas discharged from the branch pipes 11*a*, 11*b*, 11*c*, 11*d* can be appropriately guided toward the drawn portion 25 while being converged, without being caused to dwell. Because of this, the influence of the pressure loss on the cylinders can be lessened.

Besides, since the inner peripheral surface of the exhaust gas lead-out portion 27 is formed as a curved plane that is convex radially outwards, the exhaust gas discharged from the drawn portion 25 can be appropriately guided to the three-way catalyst 4 without occurrence of the dwelling of exhaust gas. Because of this, the influence of the pressure loss on the cylinders can be lessened.

Figure 10:
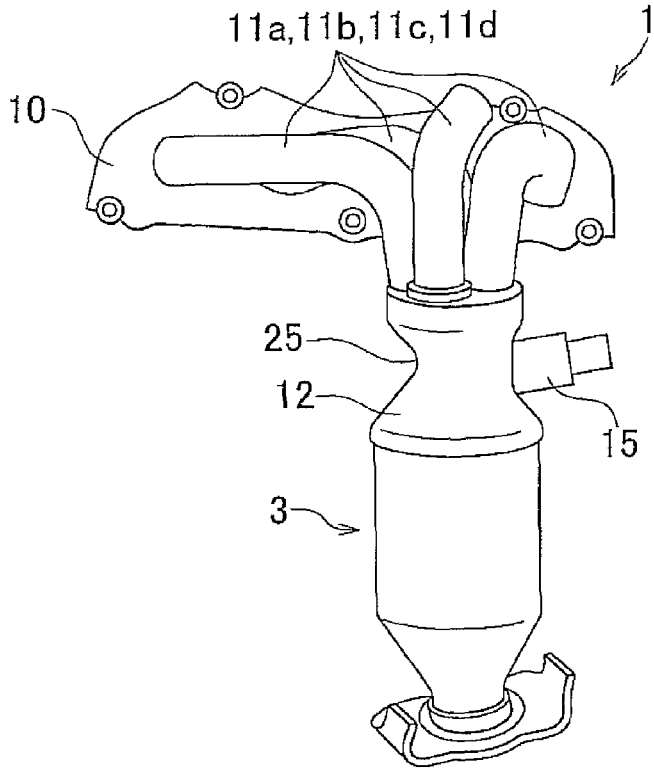
FIG. 10 is an exterior perspective view of an exhaust manifold in accordance with a modification of the invention.

Although in the embodiment, the drawn portion 25 is formed by drawing so as to be constricted in radial directions all around the circumference of the junction pipe 12, this is not restrictive. The drawn portion 25 may be formed so that at least a portion of the junction pipe 12 is constricted in a radial direction, as in a modification shown in FIG. 10. In this case, it is preferable that the air-fuel ratio sensor 15 be provided on a portion of the junction pipe 12 that is opposite to the drawn portion 25 about the axis of the junction portion 12 in a view thereof in the axial direction. Concretely, the air-fuel ratio sensor 15 is disposed directly under the partition wall 20 between the branch pipe 11*b* and the branch pipe 11*d*, and the drawn portion 25 is formed in a portion of the junction pipe 12 that is positioned directly under the partition wall 20 between the branch pipe 11*a* and the branch pipe 11*c*.

Because of this, when exhaust gas from the cylinders flows into the junction pipe 12, the exhaust gas passes through the exhaust gas lead-in portion 26 of the junction pipe 12, and then flows into the drawn portion 25 of the junction pipe 12. At that time, a portion of the exhaust gas hits the inner peripheral surface of the drawn portion 25, and changes its flow direction. Specifically, as the exhaust gas discharged from the branch pipes 11*a*, 11*c* positioned remote from the air-fuel ratio sensor 15 passes through the drawn portion 25, a portion of the exhaust gas forms an exhaust gas flow that moves radially inwards, and the exhaust gas moving radially inwards hits the air-fuel ratio sensor 15.

This construction, too, is able to guide exhaust gas to the air-fuel ratio sensor by the drawn portion 25, so that the accuracy in the detection of the air-fuel ratio by the air-fuel ratio sensor 15 can be improved.

As described above, the invention is useful in the exhaust manifold that guides exhaust gas discharged from an engine, and is particularly suitable to the case where the exhaust manifold is provided with a sensor that detects the oxygen concentration, such as an air-fuel ratio sensor or the like.

What is claimed is:

1. An exhaust manifold comprising:

a plurality of branch pipes that guide exhaust gas discharged from cylinders; and a junction pipe that converges downstream-side end portions of the plurality of branch pipes in a flow direction of exhaust gas, and that has a drawn portion that is formed by drawing so as to be constricted in a radial direction of the drawn portion, wherein the junction pipe is provided with a sensor that detects oxygen concentration in exhaust gas, and the sensor is provided at a downstream side of a deepest draw inside diameter in the flow direction of exhaust gas, and the deepest draw inside diameter is the smallest inside diameter of the drawn portion, the junction pipe includes a lead-in portion that is provided at an upstream side of the drawn portion in the flow direction of exhaust gas and that guides the exhaust gas discharged from the branch pipes, into the drawn portion, and a lead-out portion that is provided at the downstream side of the drawn portion in the flow direction of exhaust gas and that guides the exhaust gas out toward a purification catalyst device, and the drawn portion is formed so that an inner peripheral surface of the drawn portion is curved and protruded radially inwards, in a section of the drawn portion taken along an axial direction of the junction pipe.

2. The exhaust manifold according to claim 1, wherein the drawn portion is formed so as to be radially constricted all around a circumference of the junction pipe.

3. The exhaust manifold according to claim 1, wherein the drawn portion is formed so that at least a portion of the junction pipe in a circumferential direction is constricted in a radial direction of the drawn portion, and wherein the sensor is provided at a portion of the junction pipe that is opposite to the drawn portion about an axis of the junction pipe.

4. The exhaust manifold according to claim 1, wherein the lead-in portion is formed so that an inner peripheral surface of the lead-in portion is curved and protruded radially inwards, in a section of the lead-in portion taken along an axial direction of the junction pipe.

5. The exhaust manifold according to claim 1, wherein the lead-in portion includes a lead-in straight portion that is formed to a predetermined length from an upstream-side end of the lead-in portion in the flow direction of exhaust gas, a lead-in curve portion that reduces in diameter continuously from the lead-in straight portion, and a lead-in funnel portion that is formed to a predetermined length continuously from the lead-in curve portion.

6. The exhaust manifold according to claim 1, wherein the lead-out portion is formed so that an inner peripheral surface of the lead-out portion is curved and protruded radially inwards, in a section of the lead-out portion taken along an axial direction of the junction pipe.

7. The exhaust manifold according to claim 1, wherein the lead-out portion includes a lead-out funnel portion that is formed to a predetermined length from an upstream-side end portion of the lead-out portion in the flow direction of exhaust gas, a lead-out curve portion that expands in diameter continuously from the lead-out funnel portion, and a lead-out straight portion that is formed to a predetermined length continuously from the lead-out curve portion.

8. The exhaust manifold according to claim 1, wherein a diameter ratio $K=D2/D1$ is $0.7<K<1$, where D1 is an inside diameter of an upstream-side end portion of the junction pipe in the flow direction, and D2 is the deepest draw inside diameter.

9. The exhaust manifold according to claim 1, wherein the sensor is disposed so as to be positioned directly under a partition wall that is formed between the branch pipes that are converged at downstream-side end portions of the branch pipes in the flow direction of exhaust gas.

10. The exhaust manifold according to claim 9, wherein the sensor is disposed to extend in parallel with the partition wail.

11. The exhaust manifold according to claim 1, wherein the sensor is provided near the deepest draw inside diameter.

* * * * *

UNITED STATES PATENT AND TRADEMARK OFFICE

CERTIFICATE OF CORRECTION

PATENT NO. : 8,099,954 B2
APPLICATION NO. : 12/497161
DATED : January 24, 2012
INVENTOR(S) : Koichi Hoshi It is certified that error appears in the above-identified patent and that said Letters Patent is hereby corrected as shown below:

Column 10, Line 23 delete “wail” insert --wall--.

Signed and Sealed this
Thirty-first Day of July, 2012

David J. Kappos

David J. Kappos
*Director of the United States Patent and Trademark Office*